US006430265B2

(12) United States Patent
Prins et al.

(10) Patent No.: US 6,430,265 B2
(45) Date of Patent: Aug. 6, 2002

(54) X-RAY APPARATUS INCLUDING A FILTER PROVIDED WITH FILTER ELEMENTS HAVING AN ADJUSTABLE ABSORPTION

(75) Inventors: Menno Willem Jose Prins; Edward Willem Albert Young; Jeroen Van Velzen, all of Eindhoven (NL); Brian Kenneth Herbert, East Grinstead (GB)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/775,847

(22) Filed: Feb. 2, 2001

(30) Foreign Application Priority Data

Feb. 4, 2000 (EP) ..... 00300915

(51) Int. Cl.[7] ..... G21K 3/00
(52) U.S. Cl. ..... 378/158; 378/157
(58) Field of Search ..... 378/156, 158, 378/157, 145

(56) References Cited

U.S. PATENT DOCUMENTS 3,930,065 A 12/1975 Baker et al. ..... 427/89
5,625,665 A 4/1997 Fokkink ..... 378/156
5,666,396 A 9/1997 Linders et al. ..... 378/156
6,118,855 A * 9/2000 Welters et al. ..... 378/158
6,188,749 B1 * 2/2001 Schiller et al. ..... 378/158
6,198,806 B1 * 3/2001 Prins ..... 378/159
6,252,939 B1 * 6/2001 Young et al. ..... 378/156

* cited by examiner

*Primary Examiner*—Robert H. Kim
*Assistant Examiner*—Irakli Kiknadze
(74) *Attorney, Agent, or Firm*—John Vodopia

(57) ABSTRACT

An X-ray apparatus with an X-ray source for producing a beam of X-rays, an X-ray detector for detecting the beam, and an X-ray filter with filter elements. The X-ray filter is arranged between the X-ray source and the X-ray detector to attenuate the X-ray beam in each independent filter element individually. Each filter element can receive a liquid which is electrically conductive and X-ray absorbing, and is supplied via a transport channel, the X-ray absorptivity of each filter element being discretely adjustable by step-wise adjustment of the level of the liquid in each filter element. Each filter element includes a first electrode which is located in the wall of the filter element, on top of a substrate layer for applying an electric potential to the wall of the filter element. A second electric potential is applied to the liquid via a second electrode. Th first electrode is segmented in the longitudinal direction z of the filter element in order to achieve reproducible, step-wise filling of the filter element with the X-ray absorption liquid.

5 Claims, 5 Drawing Sheets

Figure 1:
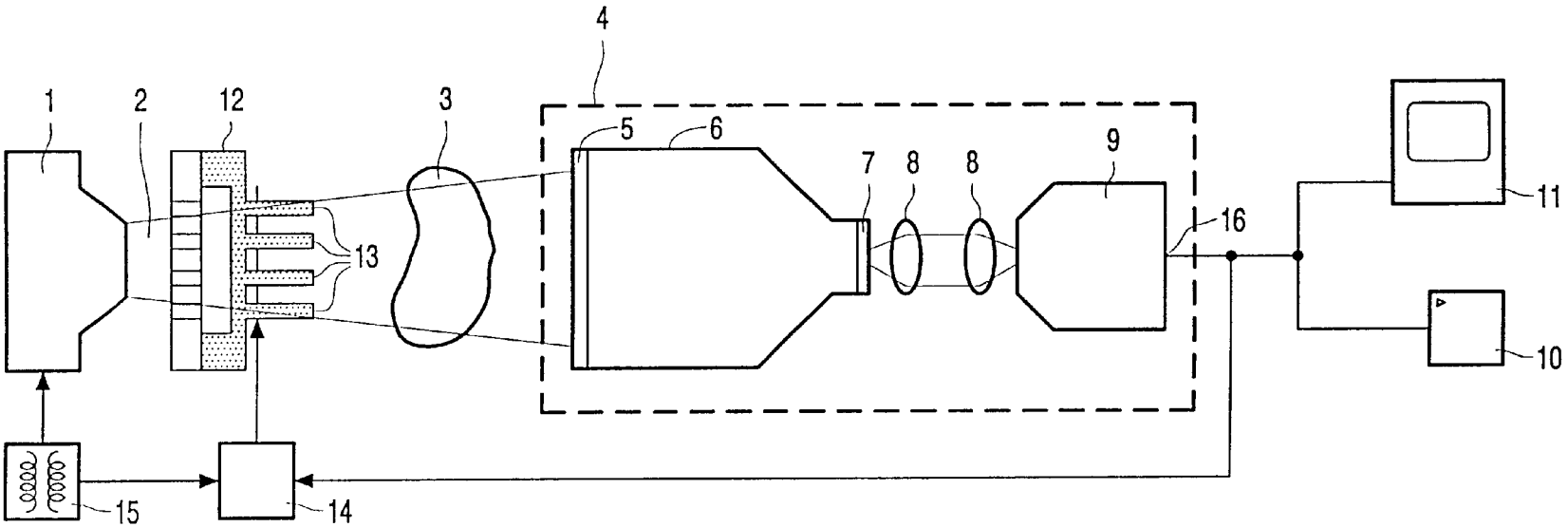

X-RAY APPARATUS INCLUDING A FILTER PROVIDED WITH FILTER ELEMENTS HAVING AN ADJUSTABLE ABSORPTION

The invention relates to an X-ray apparatus which includes an X-ray source for producing X-rays, an X-ray detector for detecting the X-rays, a filter which is arranged between the X-ray source and the X-ray detector and includes a plurality of tubular filter elements having a longitudinal direction z and a circumference, the X-ray apparatus also including an electrical device which is provided with at least one power supply source for controlling the individual filter elements, each filter element having an internal volume for receiving a liquid filling having electrically conductive and X-ray absorbing properties, said filter element having an X-ray absorptivity which is dependent on the quantity of X-ray absorbing liquid present in the internal volume, each filter element being provided with a first electrode for applying a first electric potential to a wall of the filter element and a second electrode for applying a second electric potential to the internal volume of the filter element, and the X-ray absorptivity of each filter element being adjustable by step-wise control of a level of the X-ray absorbing liquid in the longitudinal direction z of the filter element.

BACKGROUND OF THE INVENTION

An X-ray apparatus of this kind which includes an X-ray filter is known from United States patent U.S. Pat. No. 5,666,396 (PHN 15.378). The known X-ray apparatus comprises a filter with a plurality of filter elements having individual absorptivities which are dependent on a level of a liquid filling present in the filter element. The X-ray apparatus is used inter alia for medical diagnosis where a patient to be examined is arranged between the X-ray source and the X-ray detector so as to image internal structures. Thanks to the fact that the patient has structures of different electron density, regions of different density are observed in a resultant X-ray image. The interval in density between regions with the extremes of the density in an X-ray image is defined as the dynamic range. The filter serves to limit a dynamic range for each X-ray image.

In order to limit the dynamic range of the object to be examined, the known X-ray apparatus includes a filter with filter elements provided with a bundle of tubes for receiving a liquid filling which is X-ray absorbing as well as electrically conductive, each tube being connected to a common supply channel. Each filter element is provided with a first electrode which is arranged in a wall of the filter element in order to apply an electric voltage to the wall of the filter element. A second electrode is in contact with the liquid filling. The electric voltage applied to the first electrode of the filter element influences the adhesion between the liquid filling and an inner wall of the filter element; this adhesion determines whether the relevant filter element is filled with the liquid filling. The relative quantity of liquid filling in individual filter elements is controlled on the basis of the electric voltages applied to individual filter elements. The known apparatus utilizes the phenomenon that a contact angle between an electrically conductive liquid and an electrode which is insulated therefrom is changed by applying a potential difference between the electrically conductive liquid and the electrode. This phenomenon is known as electrowetting. When electrowetting is applied to a tubular filter element which has an electrode arranged in the wall and is filled with an electrically conductive liquid filling, the level of the liquid filling in the filter element can be influenced thanks to the fact that the electrowetting force is directed in the longitudinal direction of the filter element so that the degree of filling of the filter element can be increased or decreased as desired. In order to enable the potential difference to be realized between the liquid filling and the first electrode in the wall of the filter element, they are electrically insulated from one another by means of an insulation layer provided on the inner wall of the filter element. The known apparatus operates as follows: in the presence of a first value of the electric voltage, the adhesion of the liquid filling to the inner wall is increased and the relevant filter element is filled with the liquid filling from the supply channel. In the presence of a second value of the electric voltage the adhesion is reduced and the liquid filling is discharged from the filter element to the supply channel. Filter elements are adjusted to a high X-ray absorptivity by filling the elements with the liquid filling; filter elements are adjusted to a low X-ray absorptivity by keeping the filter elements empty.

It is a drawback of the known device that the filling of each filter element is controlled by application of a sequence of electric voltage pulses to the first electrode of the filter element so that the filter element is electrically charged. The level of the electric charge defines the degree of filling of the filter element. It has been found that the filling level of the filter element becomes poorly reproducible in the course of time. In practice it is often desirable to make the filling reproducible with an a priori known degree of discretization in order to achieve a reliable range of grey values.

SUMMARY OF THE INVENTION

It is an object of the invention to provide an X-ray apparatus which includes a filter provided with filter elements whose X-ray absorptivity can be step-wise controlled in a reliable and reproducible manner. To this end, an X-ray apparatus according to the invention is characterized in that the first electrode includes a series of electrode segments which extend at least over a part of the circumference of the filter element and succeed one another in the longitudinal direction of the filter element, directly successive electrode segments being electrically insulated from one another and individually controllable by the electrical device. This step offers the desired effect in that each filter segment includes a stack of electrode segments in the longitudinal direction, the degree of segmentation being known a priori. Thanks to the fact that the electrode segments are electrically insulated from one another, the filter element can be step-wise filled with the liquid filling. The absolute value of the electric voltage applied to an individual electrode segment can be chosen to be such that the secondary effects on the reproducibility of the filling, that is, the orientation of the filter element relative to the force of gravity and the aging effects of the cover layer (a protective layer between the insulator layer and the liquid filling) are compensated. A number of different possibilities can be distinguished for explaining the process of the step-wise filling of the filter element. In order to realize a liquid filling having electrically conductive and X-ray absorbing properties, an electrically conductive and X-ray absorbing salt can be dissolved in a liquid (for example, water). This solution, consisting of one component, thus has electrically conductive as well as X-ray absorbing properties. It is also feasible to realize a liquid filling having said properties by dissolving a first substance having exclusively electrically conductive properties and a second substance having exclusively X-ray absorbing properties. The resultant liquid filling thus contains fully miscible liquid components. Another possibility is to form said liquid filling from a number of, for example two non-miscible liquid components, one of which has the required electrically conductive properties while the other has the required X-ray absorbing properties.

The operation of the filter element will now be described first of all for the first two above-mentioned cases where the liquid filling consists of one liquid which is electrically conductive as well as X-ray absorbing, for example a salt solution or a liquid metal. It is also assumed that the filter element is initially empty and that no potential difference is present as yet between the liquid filling and the first electrode. Furthermore, a distinction is made between a "filling" voltage for completely filling the electrode segment and a "draining" voltage for draining the electrode segment. In order to fill the filter element up to an $n^{th}$ electrode segment, a "filling" voltage must be applied to all electrode segments up to and including n−1. In order to make the liquid level rise further, the "filling" voltage must be applied to the directly subsequent electrode segment. For optimum effect of this control chart it is advantageous when the directly successive segments are arranged in the vicinity of one another in such a manner that the meniscus of the liquid filling in the preceding electrode segment experiences an electric field of the directly subsequent segment, provided that an electric potential has been applied to the directly subsequent electrode segment. A second advantageous step for achieving an optimum effect of the filter element consists in creating a given time overlap during which the "filling" voltage is applied to both directly successive electrode segments. As soon as the meniscus of the liquid filling is present in the next electrode segment, the electric potential of the preceding electrode segment may be adjusted to the value of the "draining" voltage.

As has already been stated, the liquid filling may also be composed of more, notably two, non-miscible liquid components. In that case the properties of the liquid components can be individually optimized, so that one liquid component has optimum electrically conductive properties and is hardly X-ray absorbing while the second liquid component has optimum X-ray absorbing properties and is electrically insulating. For an optimum effect of the filter element provided with the liquid filling consisting of two liquid components, the respective liquid columns should adjoin one another so that a common interface is formed in the transverse direction. It is also feasible for the two liquid components to remain separated from one another by a gas layer. Furthermore, it must be possible to supply the liquid components from a respective supply channel. In that case the filter element is always filled with the liquid filling, the degree of X-ray absorption then being determined by the level of the X-ray absorbing liquid component in the filter element. In this case the operation of the filter element is similar to that of the described control chart. According to this method the level of the X-ray absorbing liquid component is determined passively by the level of the electrically conductive liquid component in the filter element and the maximum X-ray absorption is reached when the filter element is completely filled with the X-ray absorbing liquid component.

For ease of control it is also possible to introduce sub-groups of electrode segments. To this end, a first embodiment of the X-ray apparatus according to the invention is characterized in that the electrode segments bearing even sequence numbers in the series and the electrode segments bearing odd sequence numbers in the series constitute respective sub-groups, the electrical device being provided with switches for controlling said sub-groups. In order to achieve the step-wise filling in this configuration it is advantageous to create a time overlap between the "filling" voltage pulses on the directly successive electrode segments and to adjust the value of the electrical voltage to the "draining" voltage as soon as the meniscus of the liquid filling is present in the next electrode segment.

A further embodiment is characterized in that each electrode segment is connected to the electrical device via a respective connection. This embodiment offers the advantage that the individual electrode segments do not constitute electrical groups, with the result that it is not necessary to adjust the electric voltage of the preceding electrode segment to the value of the "draining" voltage as soon as the next electrode segment is filled.

It may be advantageous to make the edges of the directly successive segments overlap one another in space. To this end, a third embodiment according to the invention is characterized in that facing edges of directly successive electrode segments are provided with meshing teeth. This step ensures that the meniscus of the absorption liquid is in contact with a part of the edge surface of the next segment, so that the distance between the neighboring segments becomes less critical.

BRIEF DESCRIPTION OF THE DRAWING FIGURES

Figure 2A:
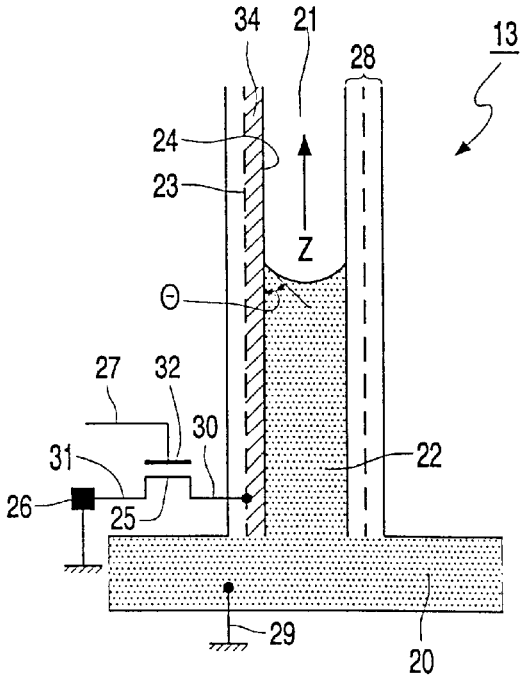
Figure 2B:
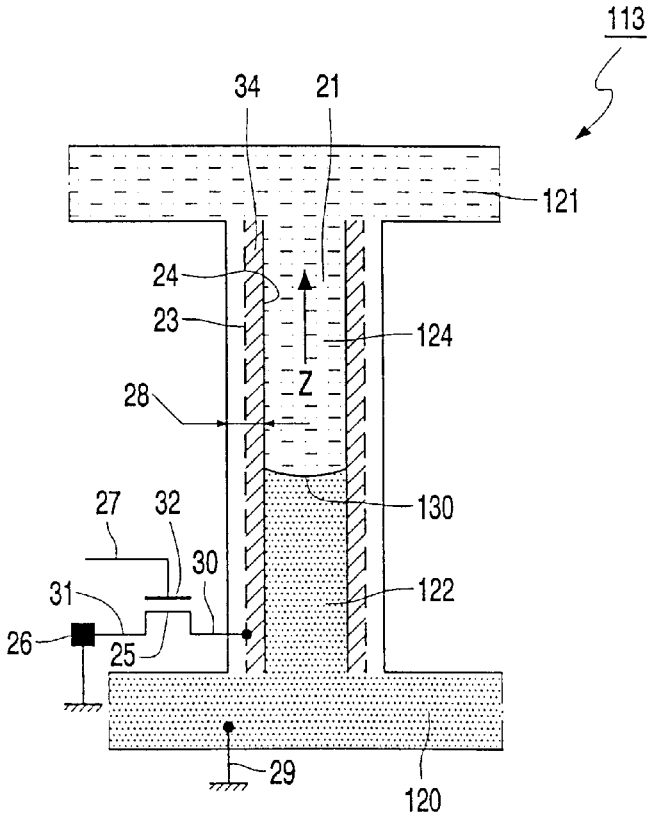
Figure 3:
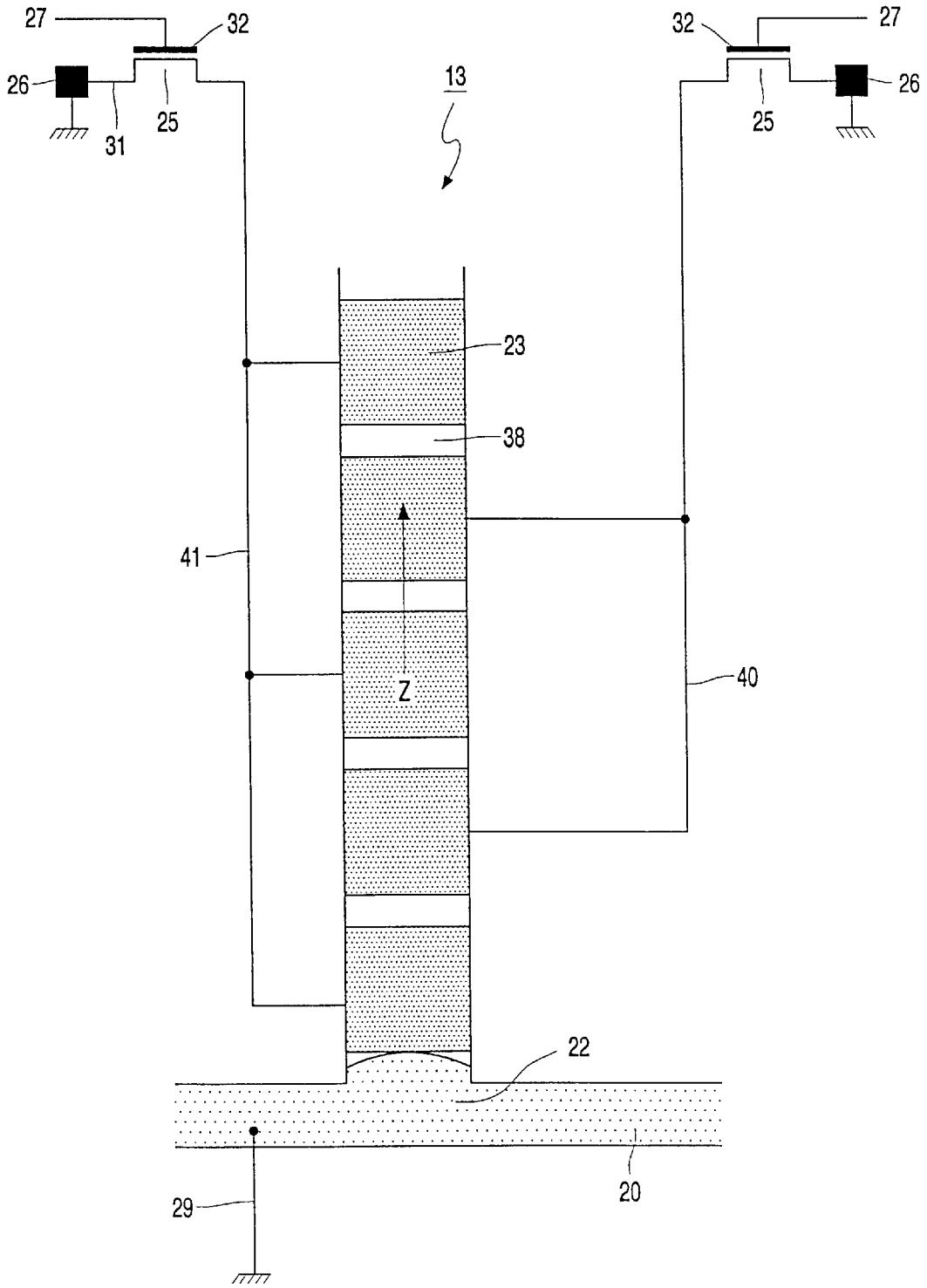
Figure 4:
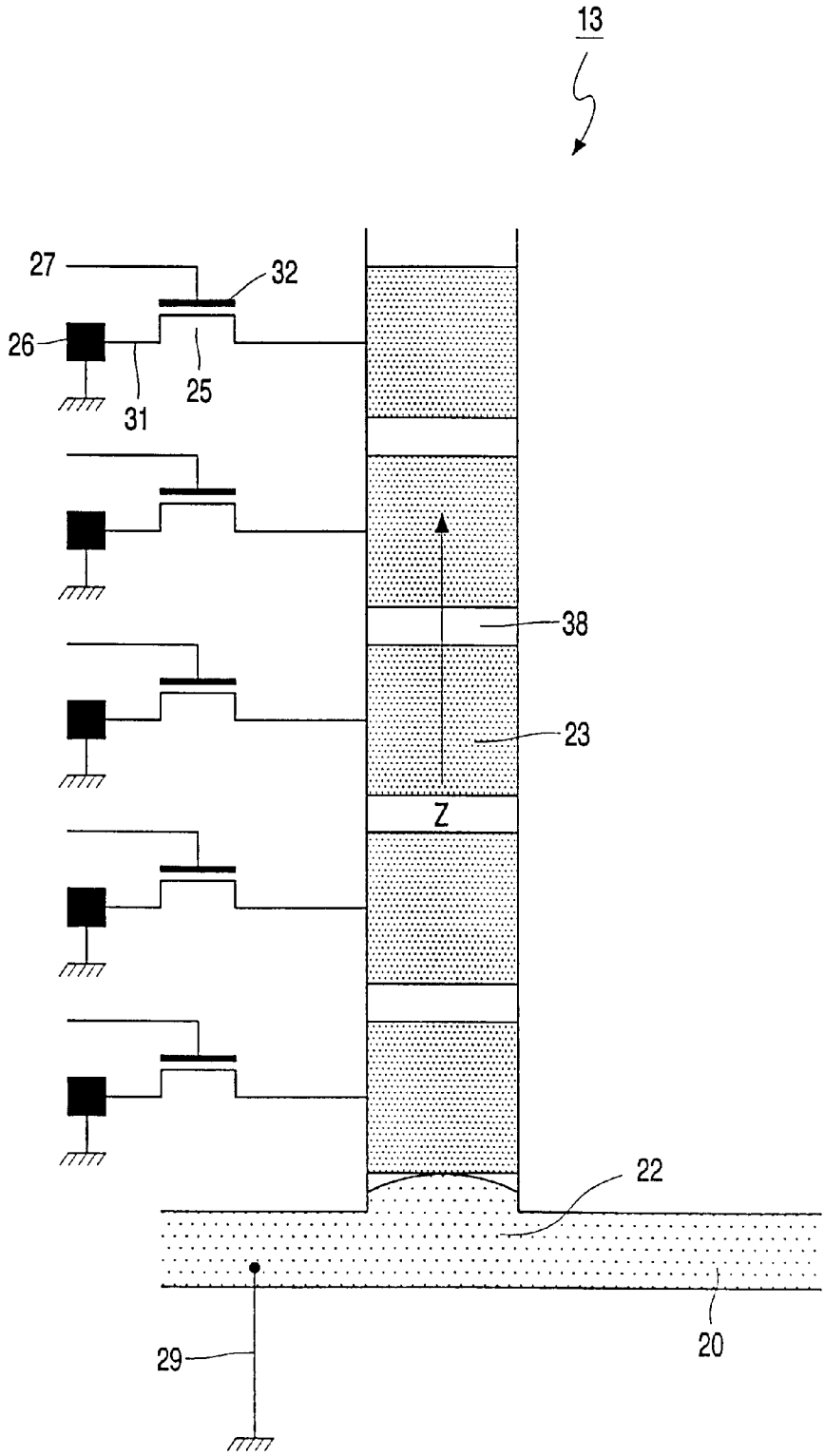

These and other aspects of the invention will be described in detail hereinafter with reference to the following embodiments and the accompanying drawing; therein FIG. 1 shows diagrammatically an X-ray apparatus according to the invention, FIG. 2*a* is a diagrammatic sectional view of a filter element of the filter of FIG. 1 which is filled with a liquid filling consisting of two fully miscible liquid components, FIG. 2*b* is a diagrammatic sectional view of a filter element of the filter of FIG. 1 which is filled with the liquid filling consisting of two non-miscible liquid components, FIG. 3 is a diagrammatic 360° view of the first electrode with electrode segments forming sub-groups, FIG. 4 is a diagrammatic 360° view of the first electrode with individually controlled electrode segments, and FIG. 5 is a diagrammatic 360° view of the first electrode with segments provided with teeth.

DETAILED DESCRIPTION OF THE INVENTION

FIG. 1 shows diagrammatically an X-ray apparatus with a filter according to the invention. The X-ray source 1 emits an X-ray beam 2 whereto an object 3, for example a patient to be examined, is exposed. Due to local differences in the absorption of X-rays in the object 3, an X-ray image is formed on the X-ray detector 4, being an image intensifier pick-up chain in the present example. The X-ray image is formed on the entrance screen 5 of the X-ray image intensifier 6 and is converted into an optical image on the exit window 7 which is imaged on a video camera 9 by means of a system of lenses 8. The video camera 9 forms an electronic image signal from the optical image. For example, for the purpose of further processing the electronic image signal is applied to an image processing unit 10 or to a monitor 11 on which the image information contained in the X-ray image is displayed.

A filter 12 for locally attenuating the X-ray beam 2 is arranged between the X-ray source 1 and the object 3. The filter 12 includes a plurality of tubular filter elements 13, the X-ray absorptivity of which is adjustable by application, by way of an adjusting circuit 14, of electric voltages to the wall of the filter elements. The electric voltages are adjusted, for example, on the basis of the setting of the X-ray source 1 with the power supply 15 of the X-ray source and/or on the basis of, for example, brightness values of the X-ray image which can be derived from the signal present at the output terminal 16 of the video camera 9. The general construction of such a filter 12 and the composition of the absorption liquid are described in detail in United States patent U.S. Pat. No. 5,625,665 (PHN 15.044).

FIG. 2*a* is a diagrammatic sectional view of a tubular filter element 13 of a filter as shown in FIG. 1. Via the supply channel 20 the filter element 13 is filled with the liquid filling 22 which is electrically conductive and X-ray absorbing. For each filter element there are defined the longitudinal direction z and the internal volume 21, the latter being bounded by the walls 28 of the filter element. Each filter element includes the first electrode 23 in the form of an electrically conductive layer which is electrically insulated, by means of an insulation layer 34, from the liquid filling present in the internal volume 21, an inert cover layer 24 which is provided on an inner side of the walls 28, and a second electrode 29 for applying an electric potential to the liquid filling. The electrically conductive layer 23 of the filter element 13 is coupled to a switching element which is in this case formed by a drain contact 30 of a field effect transistor 25, its source contact 31 being coupled to a voltage line 26. The field effect transistor 25 is turned on, that is, the switching element is closed by means of a control voltage which is applied to a gate contact 32 of the field effect transistor 25 via the control line 27. The electric voltage of the voltage line 26 is applied to the electrically conductive layer 23 by closing the switching element. When the voltage line is adjusted to the value of the "filling" voltage, the contact angle θ of the liquid filling 22 relative to the inert cover layer 24 decreases and the relevant filter element is filled with the liquid filling.

FIG. 2*b* is a diagrammatic sectional view of the tubular filter element 113 of a filter as shown in FIG. 1, the filter element now being filled with the liquid filling consisting of an electrically conductive liquid component 122 and an X-ray absorbing liquid component 124. The liquid components are supplied via respective supply channels 120 and 121. The further functional parts of the filter element 113 are substantially identical to those of the filter element 13, so that the control chart for the electrically conductive liquid component can be similar. This control chart determines the level of the electrically conductive liquid component 122 in the internal volume 21 of the filter element 113 which itself determines the level of the X-ray absorbing liquid component 124 in the filter element 113, because the respective components constitute one common liquid column with an interface 130. The degree of X-ray absorption is in this case determined by the degree of filling of the filter element 113 with the X-ray absorbing component 124.

FIG. 3 is a 360° view of the electrode segments 23 on a substrate 38 in a first embodiment of the filter element 13 according to the invention, the electrode segments bearing even sequence numbers 40 in the series and the electrode segments bearing odd sequence numbers 41 in the series constituting respective sub-groups and the electrical device being provided with switches 25 for controlling said sub-groups. The field effect transistors in this embodiment again act as switching elements. It is an advantage of the present embodiment that the electrical wiring is simplified. For optimum transport of the liquid filling in the longitudinal direction z of the filter element, in this embodiment a given time overlap is desired between the pulses of the electric "filling" voltages applied to both sub-groups. As soon as the meniscus of the liquid filling is present in the $N^{th}$ electrode segment to be filled, the voltage applied to the electrode segments of the other sub-group must be adjusted to the value of the "draining" voltage, unless transport to the $N+1^{th}$ electrode segment is required.

In order to make the latter switching superfluous, a second embodiment of the filter element 13 is presented in which each electrode segment is connected to the electrical device via a respective connection. FIG. 4 is a 360° view of the projection of the electrode segments 23 on a substrate 38 in this embodiment. For optimum transport of the liquid filling in the longitudinal direction z of the filter element, a given time overlap is desired between the pulses of the electric "filling" voltages applied to both sub-groups in this embodiment.

Figure 5A:
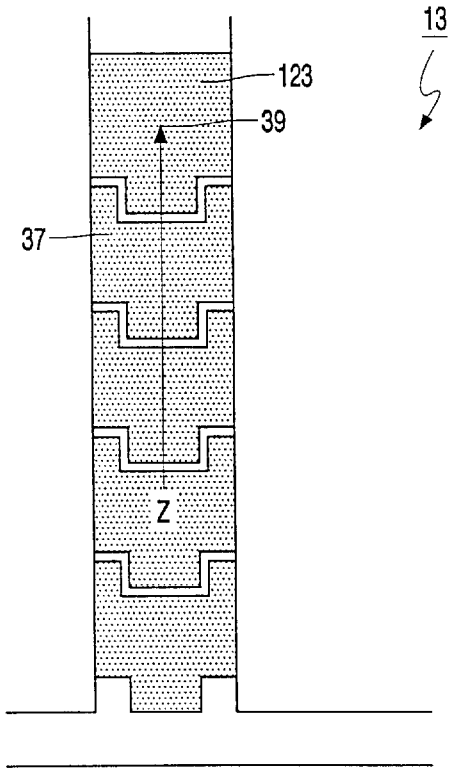
Figure 5B:
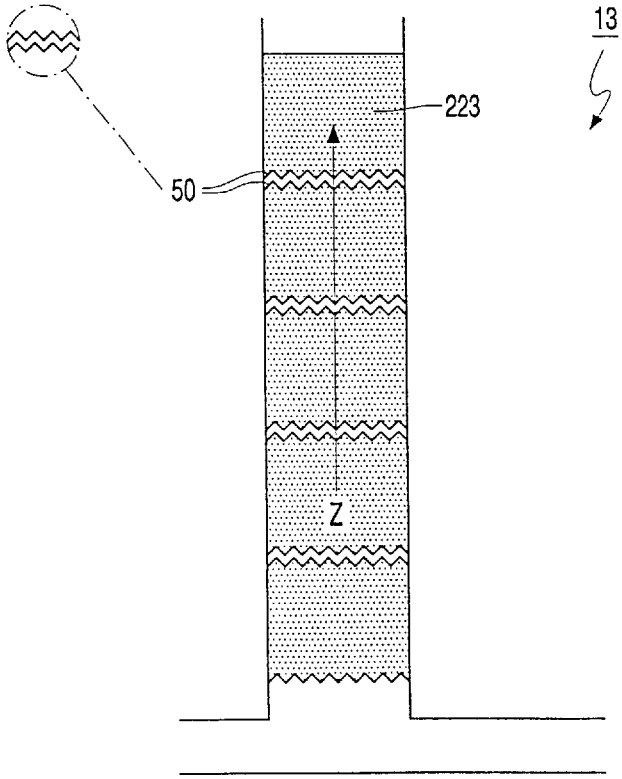

FIG. 5 is a diagrammatic 360° view of the electrode segments of the filter element 13 in a fourth embodiment according to the invention, wherein the facing edges of directly successive electrode segments are provided with meshing teeth. This step enhances the reliability of the transport of the liquid filling in the longitudinal direction z of the filter element. FIG. 5*a* shows an example of the crenellation-like teeth 37 and 39 of the electrode segments of the type 123. FIG. 5*b* shows an example of the sawtooth-like teeth 50 of the electrode segment of the type 223.

What is claimed is:

1. An x-ray apparatus which includes an X-ray source for producing X-rays, an X-ray detector for detecting the X-rays, a filter which is arranged between the X-ray source and the X-ray detector, which filter includes a plurality of tubular filter elements having a longitudinal direction z and a circumference, the X-ray apparatus also including an electrical device which is provided with at least one power supply source for controlling the individual filter elements, wherein each filter element is constructed with an internal volume for receiving a liquid filling having electrically conductive and X-ray absorbing properties, and wherein each filter element displays an X-ray absorptivity which is dependent on the quantity of X-ray absorbing liquid present in the internal volume, wherein each filter element includes a first electrode for applying a first electric potential to a wall of the filter element, and a second electrode for applying a second electric potential to the internal volume of the filter element, wherein the X-ray absorptivity of each filter element is adjustable by step-wise control of a level of the X-ray absorbing liquid in the longitudinal direction z of the filter element, and wherein the first electrode includes a series of electrode segments which extend at least over a part of the circumference of the filter element and succeed one another in the longitudinal direction z of the filter element, and said directly successive electrode segments are electrically insulated from one another and individually controllable by the electrical device.

2. A filter for use in the X-ray apparatus as set forth in claim 1, wherein the electrode segments are subdivided into at least two sub-groups, each sub-group including at least two not directly successive electrode segments, the electrode segments in each sub-group being electrically interconnected.

3. The filter as set forth in claim 2, wherein the electrode segments bear even sequence numbers in the series and the electrode segments bear odd sequence numbers in the series constitute respective sub-groups, the electrical device being provided with switches for controlling said sub-groups.

4. A filter for use in the X-ray apparatus as set forth in claim 1, wherein each electrode segment is connected to the electrical device via a respective connection.

5. A filter for use in the X-ray apparatus as set forth in claim 1, wherein facing edges of directly successive electrode segments are provided with meshing teeth.

* * * * *